US006206594B1

(12) United States Patent
Elgee et al.

(10) Patent No.: US 6,206,594 B1
(45) Date of Patent: Mar. 27, 2001

(54) PRINT MEDIA LEVEL SENSOR AND METHOD FOR USE IN PRINTING DEVICES

(75) Inventors: Steven B. Elgee, Portland, OR (US); John A. Underwood, Sant Cugat del Valles (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/410,347

(22) Filed: Sep. 30, 1999

(51) Int. Cl.[7] ..... B41J 29/18

(52) U.S. Cl. ..... 400/703; 101/232; 271/258.01; 270/58.01; 414/788.1; 414/800

(58) Field of Search ..... 400/624, 703, 400/718, 711; 101/232; 270/52.06, 58.01; 271/258.01, 127, 288; 414/788.1, 788, 268, 800

(56) References Cited

U.S. PATENT DOCUMENTS

| | | | | |
|---|---|---|---|---|
| 4,147,106 | * | 4/1979 | McGregor | 101/232 |
| 4,501,419 | * | 2/1985 | Takahashi et al. | 271/288 |
| 4,786,042 | * | 11/1988 | Stemmle | 271/127 |
| 4,877,346 | * | 10/1989 | Guenther et al. | 400/624 |
| 5,692,867 | * | 12/1997 | Kondo et al. | 414/268 |
| 5,785,482 | * | 7/1998 | Tanaka | 414/788 |
| 5,905,520 | * | 5/1999 | Fujii et al. | 347/153 |
| 5,938,186 | * | 8/1999 | Sato et al. | 270/58.01 |
| 6,000,871 | * | 12/1999 | Fisher, Sr. | 400/703 |
| 6,126,384 | * | 10/2000 | Darcy et al. | 414/800 |

* cited by examiner

*Primary Examiner*—Eugene Eickholt
(74) *Attorney, Agent, or Firm*—Erik A. Anderson

(57) ABSTRACT

A print media level sensor and method for determining a height of a stack of print media for use in printing devices are disclosed. An embodiment of a print media level sensor includes a print media stack follower configured to contact a top of a stack of print media and remain in contact with the top as a height of the stack changes. The print media stack follower also includes encoded data representative of a plurality of heights of the stack of print media. The print media level sensor additionally includes a decoder configured to read encoded data on the print media stack follower and output a signal representative of the encoded data. The print media stack follower may further include a computing device that receives the signal representative of the encoded data from the computing device and converts the signal representative of the encoded data into a signal representative of the stack height. An embodiment of a method includes tracking a height of a stack of print media via a print media stack follower and encoding data representing a plurality of different stack heights via the print media stack follower. The method additionally includes decoding the encoded data and generating a signal representative of the encoded data. The method may further include converting the signal representative of the encoded data into a signal representative of the height of the stack. Further characteristics and features of this apparatus and method are disclosed herein, as are exemplary alternative embodiments.

9 Claims, 4 Drawing Sheets

PRINT MEDIA LEVEL SENSOR AND METHOD FOR USE IN PRINTING DEVICES

BACKGROUND AND SUMMARY

The present invention relates to printing devices. More particularly, the present invention relates to a print media level sensor and method for use in printing devices.

Printing devices, such as inkjet printers and laser printers, use printing composition (e.g., ink or toner) to print text, graphics, images, etc. onto a print medium. Inkjet printers may use print cartridges, also known as "pens", which shoot drops of printing composition, referred to generally herein as "ink", onto a print medium such as paper, transparencies or cloth. Each pen has a printhead that includes a plurality of nozzles. Each nozzle has an orifice through which the drops are fired. To print an image, the printhead is propelled back and forth across the page by, for example, a carriage while shooting drops of ink in a desired pattern as the printhead moves. The particular ink ejection mechanism within the printhead may take on a variety of different forms known to those skilled in the art, such as thermal printhead technology.

In a current thermal system, a barrier layer containing ink channels and vaporization chambers is located between an orifice plate and a substrate layer. This substrate layer typically contains linear arrays of heating elements, such as resistors, which are energized to heat ink within the vaporization chambers. Upon heating, the ink in the vaporization chamber turns into a gaseous state and forces or ejects an ink drop from an orifice associated with the energized resistor. By selectively energizing the resistors as the printhead moves across the print medium, the ink is expelled in a pattern onto the print medium to form a desired image (e.g. picture, chart and/or text).

Printing devices typically include one or more print medium input devices, such as input trays for sheets of print media or input racks for rolls of print media. Ideally, these input devices are kept filled with an adequate supply of print media to complete required printing tasks. If not, then printing tasks will be delayed until the inadequate supply of print media is discovered and an adequate supply provided. Such delay in completing printing device jobs is problematic, particularly for larger print jobs or print jobs that are left to run unattended, such as those that are done overnight. As a consequence, printing device throughput is also reduced. Another problem of wasted print media occurs for those print jobs that run out of print media before completing and can only be started again from the beginning.

Alleviation of these problems would be a welcome improvement, thereby helping minimize delay in the completion of printing tasks, helping maximize printing device throughput, and helping prevent instances of waste of print media. Accordingly, the present invention is directed to solving those problems caused by lack of adequate print media to complete selected printing tasks. The present invention accomplishes this objective by providing a print media level sensor and method for determining a height of a stack of print media for use in printing devices. As used herein, "stack" is defined to included not only an aligned pile of print media, for example, as found in a print media input tray, but also a roll of print media as well.

An embodiment of a print media level sensor in accordance with the present invention for use in a printing device includes a print media stack follower that is configured to contact a top of a stack of print media and remain in contact with the top of the stack of print media as a height of the stack of print media changes. The print media stack follower is further configured to include encoded data representative of a plurality of heights of the stack of print media. The print media level sensor also includes a decoder that is configured to read the encoded data on the print media stack follower and to output a signal representative of the encoded data.

The above-described embodiment of a print media sensor in accordance with the present invention may be modified and include the following characteristics, as described below. The print media level sensor may further include a computing device coupled to the decoder to receive the signal representative of the encoded data therefrom. In such cases, the computing device is configured to convert the signal representative of the encoded data into a signal representative of the height of the stack of print media.

The encoded data may be formed in a body of the print media stack follower. In such cases, the encoded data may include a plurality of apertures.

The decoder may include a source configured to emit a light signal and a detector configured to receive the light signal from the source and convert the light signal into an electrical signal.

An alternative embodiment of a print media level sensor in accordance with the present invention for use in a printing device includes follower structure for tracking a height of a stack of print media. The follower structure is configured to include encoded data structure for representing a plurality of different stack of print media heights. The print media level sensor additionally includes structure for decoding the encoded data structure which is configured to output a signal representative of the encoded data.

The above-described alternative embodiment of a print media sensor in accordance with the present invention may be modified and include the following characteristics, as described below. The print media level sensor may further include computing structure coupled to the structure for decoding to receive the signal representative of the encoded data therefrom. In such cases, the computing structure is configured to translate the signal representative of the encoded data into a signal representative of the height of the stack of print media.

An embodiment of a method for determining a height of a stack of print media in accordance with the present invention for use in a printing device includes tracking a height of a stack of print media via a print media stack follower which is configured to contact a top of a stack of print media and remain in contact with the top of the stack of print media as a height of the stack of print media changes. The method additionally includes encoding data representing a plurality of different heights of the stack of print media via the print media stack follower, decoding the encoded data, and generating a signal representative of the encoded data.

The above-described embodiment of a method in accordance with the present invention may be modified and include the following characteristics, as described below. The method may further include converting the signal representative of the encoded data into a signal representative of the height of the stack of print media.

Other objects, advantages, and novel features of the present invention will become apparent from the following detailed description of the invention when considered in conjunction with the accompanying drawings.

DETAILED DESCRIPTION OF THE DRAWINGS

Figure 1:
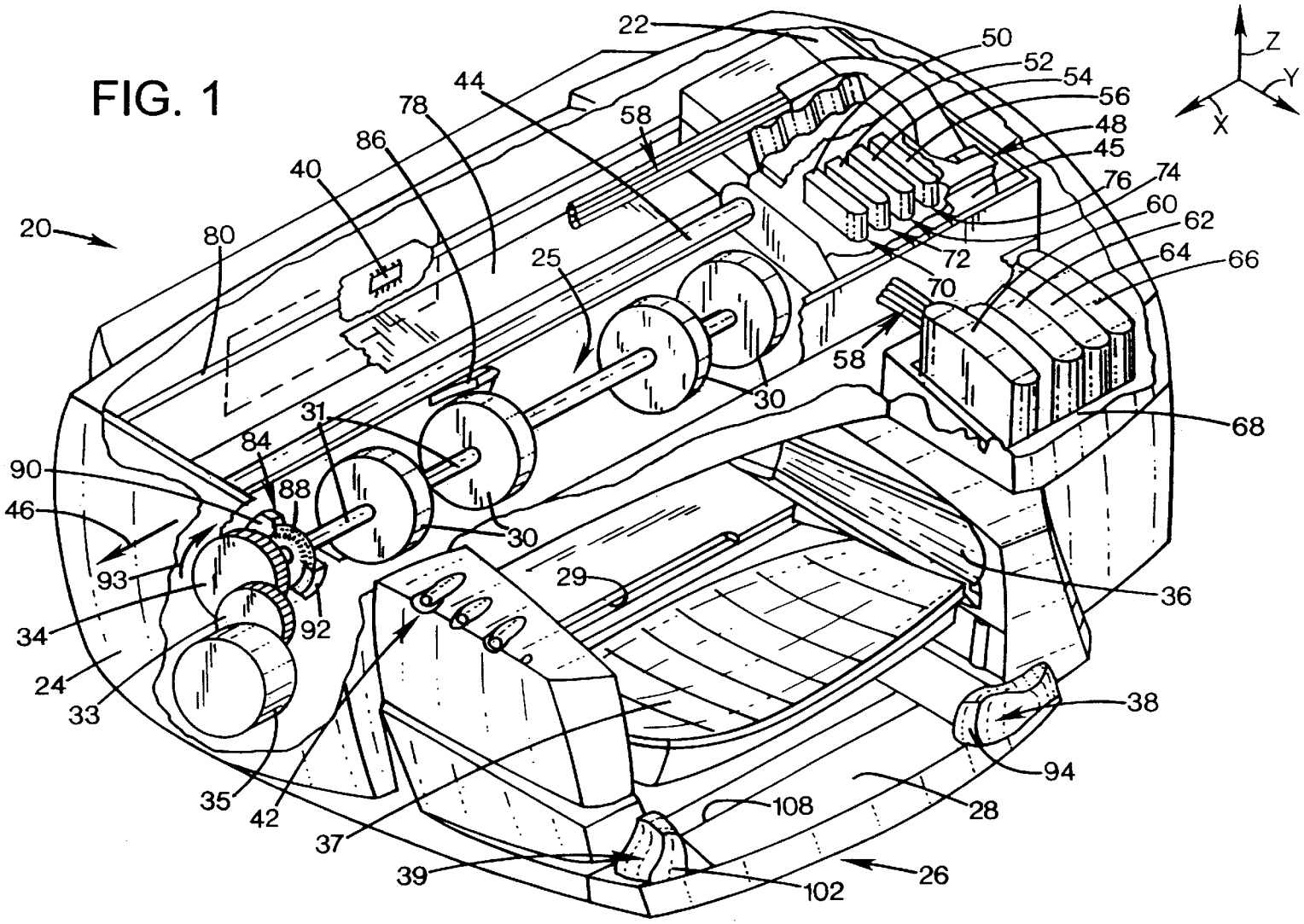
FIG. 1 is a perspective view of a printing device that includes an embodiment of the present invention.

FIG. 1 illustrates an embodiment of an inkjet printing device 20, here shown as an a "off-axis" inkjet printer, constructed in accordance with the present invention, which may be used for printing business reports, correspondence, desktop publishing, and the like, in an industrial, office, home or other environment. A variety of inkjet printing devices are commercially available. For instance, some of the printing devices that may embody the present invention include plotters, portable printing units, copiers, cameras, video printers, and facsimile machines, to name a few, as well as various combination devices, such as combination facsimiles and printers. In addition, the present invention may be used in other types of printing devices such as "on-axis" inkjet printers, dot matrix printers, and laser jet printers. For convenience, the concepts of the present invention are illustrated in the environment of inkjet printer 20.

While printing device components may vary from model to model, a typical inkjet printer 20 includes a frame or chassis 22 surrounded by a housing, casing or enclosure 24, typically made of a plastic material. Sheets of print media are fed through a printzone 25 by a print media handling system 26. The print media may be any type of suitable material, such as paper, card-stock, transparencies, photographic paper, fabric, metalized media, etc. Print media handling system 26 includes an input tray 28 for storing sheets of print media for printing. A series of conventional print media drive rollers 30 rotate about a shaft 31 which is driven by a motor 35 through a series of drive gears 33 and 34. Gears 33 and 34 are rotateably coupled to shaft 31 to rotate shaft 31 in a direction generally indicated by arrow 93. Drive rollers 30 are used to move print medium from input tray 28, through printzone 25 and, after printing, onto a pair of extendable output drying wing members 36, shown in a retracted or rest position in FIG. 1. Wings 36 momentarily hold a newly printed sheet of print media above any previously printed sheets still drying in an output tray 37. Print media handling system 26 also includes means for accommodating different sizes of print media, including letter, legal, A-4, B, envelopes, etc. This means includes a print medium length adjuster 38 and a print medium width adjuster 39. As discussed below in connection with FIG. 2, print medium length adjuster 38 and print medium width adjuster 39 are manually repositionable against the sides of different sizes of print medium, and thereby accommodate for these different sizes. An envelope feed port 29 may be used in lieu of repositioning print medium length adjuster 38 and print medium width adjuster 39 to accommodate for the smaller size of such envelopes. Although not shown, it is to be understood that print media handling system 26 may also include other items such as one or more additional input trays. Additionally, print media handling system 26 and printing device 20 may be configured to support specific print tasks such as duplex printing (i.e., printing on both sides of the sheet of print media) and banner printing.

Printing device 20 also has a computing device 40, illustrated as a microprocessor or controller, that receives instructions from a host device, typically a computer, such as a personal computer (not shown). Many of the functions of computing device 40 may be performed by a host computer, including any printing device drivers resident on the host computer, by electronics in the printing device, or by interactions between the host computer and the electronics. As used herein, the term "computing device 40" encompass these functions, whether performed by a host computer, printing device 20, an intermediary device between the host computer and printing device 20, or by combined interaction of such elements. Computing device 40 may also operate in response to user inputs provided through a keypad 42 located on the exterior of casing 24. A monitor (not shown) coupled to the computer host may be used to display visual information to a user of printing device 20, such as the printer status or a particular program being run on the host computer. Personal computers, input devices, such as a keyboard and/or a mouse device, and monitors are all known to those skilled the art.

A carriage guide rod 44 is supported by chassis 22 to slideably support an off-axis inkjet carriage 45 for travel back and forth across printzone 25 along a scanning axis generally designated by arrow 46 in FIG. 1. As can be seen in FIG. 1, scanning axis 46 is substantially parallel to be X-axis of the XYZ coordinate system shown in FIG. 1. It should be noted that the use of the words substantially in this document is used to account for things such as engineering and manufacturing tolerances, as well as variations not affecting performance of the present invention. Carriage 45 is also propelled along guide rod 44 into a servicing region, generally indicated by arrow 48, located within the interior of housing 24 of printing device 20. A conventional carriage drive gear and motor assembly (both of which are not shown in FIG. 1) may be coupled to drive an endless loop, which may be secured in a conventional manner to carriage 45, with the motor operating in response to control signals received from a computing device 40 to incrementally advanced carriage 45 along guide rod 44 in response to movement of the motor.

In printzone 25, a sheet of print medium receives ink from an inkjet cartridge, such as black ink cartridge 50 and three monochrome color ink cartridges 52, 54, and 56. Cartridges 50, 52, 54, and 56 are also called "pens" by those skill the art. Pens 50, 52, 54, and 56 each include small reservoirs for storing a supply of printing composition, referred to generally herein as "ink" in what is known as an "off-axis" ink delivery system, which is in contrast to a replaceable ink cartridge system where each pen has a reservoir that carries the entire ink supply as the printhead reciprocates over printzone 25 along carriage scan axis 46. The replaceable ink cartridge system may be considered an "on-axis" system, whereas systems which store the main ink supply at a stationary location remote from the printzone scanning axis are called "off-axis" systems. It should be noted that the present invention is operable in both off-axis and on-axis systems.

In the illustrated off-axis printing device 20, ink of each color from each printhead is delivered via a conduit or tubing system 58 from a group of main ink reservoirs 60, 62, 64, and 66 to the on-board reservoirs of respective pens 50, 52, 54, and 56. Ink reservoirs 60, 62, 64, and 66 are replaceable ink supplies stored in a receptacle 68 supported by printer chassis 22. Each of pens 50, 52, 54, and 56 has a respective printhead, as generally indicated by arrows 70, 72, 74, and 76, which selectively ejects ink to form an image on a print medium in printzone 25.

Printheads 70,72, 74, and 76 each have an orifice plate with a plurality of nozzles formed therethrough in a manner well-known to those skill the art. The illustrated printheads 70,72, 74, and 76 are thermal inkjet printheads, although other types of printheads may be used, such as piezoelectric printheads. Thermal printheads 70,72, 74, and 76 typically include a plurality of resistors which are associated with the nozzles. Upon energizing a selected resistor, a bubble of gas is formed which ejects a droplet of ink from the nozzle onto the print medium in printzone 25 under the nozzle. The printhead resistors are selectively energized in response to firing command control signals delivered by a multi-conductor strip 78 (a portion of which is shown in FIG. 1) from computing device 40 to printhead carriage 45.

An optical quadrature encoder strip 80 extends along the length of printzone 25 and over the area of service station region 48 to provide carriage 45 positional feedback information to computing device 40, with a carriage position quadrature encoder reader (not shown) being mounted on a back surface of printhead carriage 45 to read positional information provided by optical quadrature encoder strip 80. Together, optical quadrature encoder strip 80 and carriage position quadrature encoder reader constitute a printing device carriage position quadrature encoder. Printing device 20 uses optical quadrature encoder strip 80 and the carriage position quadrature encoder reader to trigger the firing of printheads 70,72, 74, and 76 and to provide feedback for position and velocity of carriage 45.

Optical encoder strip 80 may be made from things such as photo imaged MYLAR brand film, and works with a light source and a light detector (both of which are not shown) of carriage position quadrature encoder reader. The light source directs light through strip 80 which is received by the light detector and converted into an electrical signal which is used by computing device 40 of printing device 20 to control firing of printheads 70, 72, 74, and 76 and to control carriage 45 position and velocity. Markings or indicia on encoder strip 80 periodically block this light from the light detector of carriage position quadrature encoder reader in a predetermined manner which results in a corresponding change in the electrical signal from the detector of carriage position quadrature encoder reader which is processed by computing device 40.

A print medium axis position quadrature encoder 84 is also shown in FIG. 1. Print medium axis position quadrature encoder 84 provides positional feedback information to computing device 40 regarding the position of print media drive rollers 30. Printing device 20 uses print medium axis position quadrature encoder 84 in combination with flag 86 to help accurately position print medium in printzone 25 and to control printing by one or more of printheads 70, 72, 74, and 76. Flag 86 detects the presence of print medium in printzone 25. Print medium axis position quadrature encoder 84 includes a rotary encoder 88 and a pair of rotary encoder readers 90 and 92. Rotary encoder 88 is coupled to shaft 31 to rotate therewith in the direction generally indicated by arrow 93.

Rotary encoder 88 may be made from things such as photo imaged MYLAR brand film, and works with a light source and a light detector (both of which are not shown) of each of rotary encoder readers 90 and 92. These light sources direct light through rotary encoder 88 which is received by the light detectors and converted into an electrical signal which is used by computing device 40 of printing device 20 to help accurately position print medium in printzone 25 and to control firing of printheads 70, 72, 74, and 76. Markings or indicia on rotary encoder 88 periodically block this light from the light detectors of rotary encoder readers 90 and 92 in a predetermined manner which results in a corresponding change in the electrical signal from the detectors of rotary encoder readers 90 and 92 which is processed by computing device 40.

Figure 2:
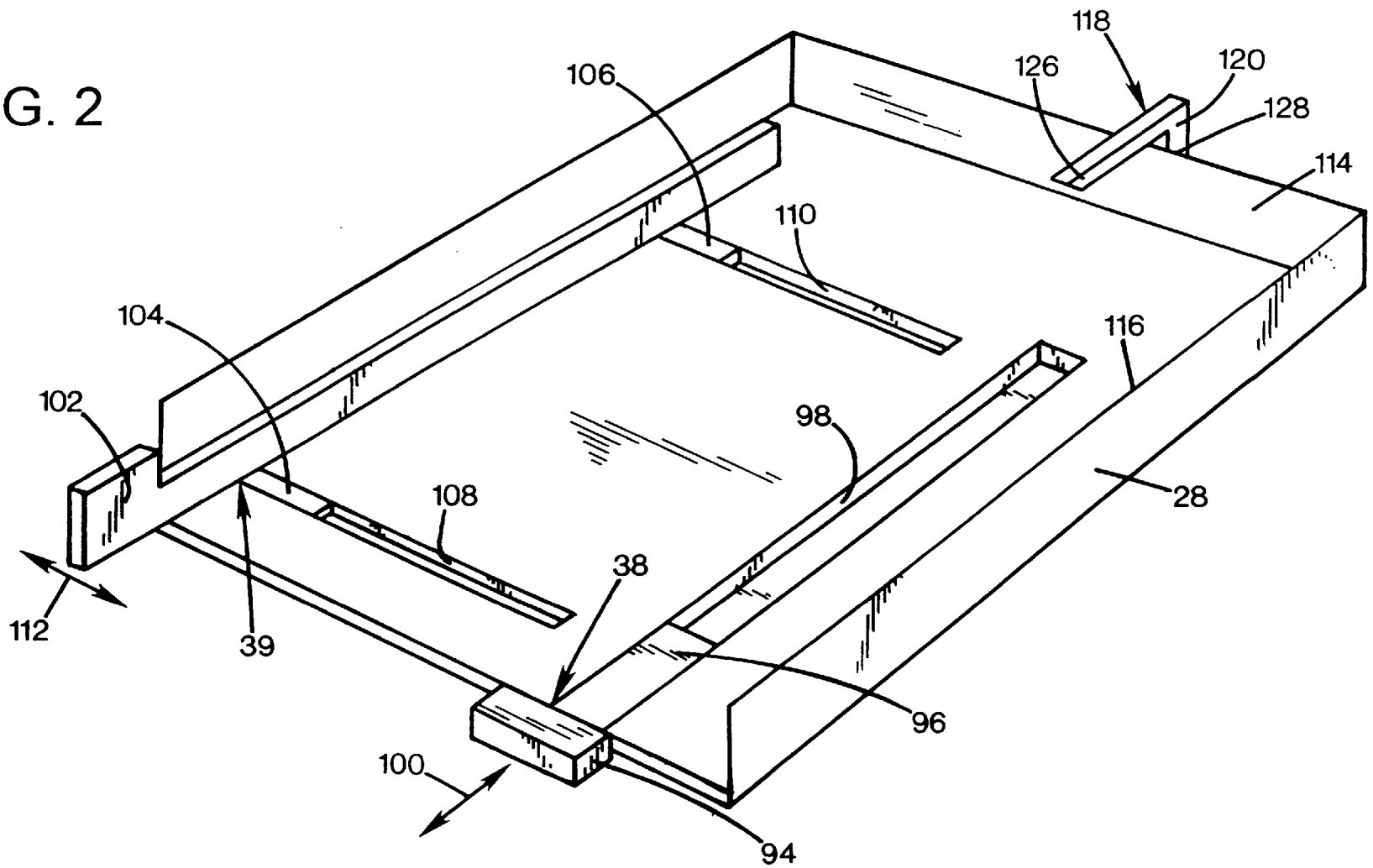
FIG. 2 is a perspective view of a print media input tray including an embodiment of a print media level sensor in accordance with the present invention.

A perspective view of a print media input tray 28 with manually repositionable print medium length adjuster 38 and a manually repositionable print medium width adjuster 39 is shown in FIG. 2. As can be seen in FIG. 2, print medium length adjuster 38 includes a handle portion 94 for manual grasping that is coupled to a base portion 96. Input tray 28 in turn is formed to include a track 98 of a predetermined length that is sized to slideably receive base portion 96 of print medium length adjuster 38. In this way, print medium length adjuster 38 is manually repositionable along the length of track 98 in the directions indicated by double-headed arrow 100 so that input tray 28 can accommodate for a variety of different lengths of print medium by placing handle portion 94 against a side of the print medium.

As can also be seen in FIG. 2, print medium width adjuster 39 includes a handle portion 102 that is coupled to base portions 104 and 106. Input tray 28 in turn is formed to include tracks 108 and 110 each of a predetermined length that are sized to slideably receive base portions 104 and 106 of print medium width adjuster 39. In this way, print medium width adjuster 39 is manually repositionable along the lengths of tracks 108 and 110 in the directions indicated by double-headed arrow 112 so that input tray 28 can accommodate for a variety of different widths of print medium by placing handle portion 102 against a side of the print medium.

In operation of printing device 20, print medium length adjuster 38 and print medium width adjuster 39 should be positioned against the sides of a print medium in input tray 28 to help assure proper registration of the print medium against respective walls 114 and 116 of input tray 28. Such registration in turn helps assure proper transport by print media handling system 26 from input tray 28 to printzone 25.

An embodiment of a print media level sensor 118 constructed in accordance with the present invention is also shown in FIG. 2. As shown and discussed more fully below in connection with FIGS. 3 and 6, print media level sensor 118 includes a print media stack follower 120 that is configured to contact a top 123 of a stack of print media 122 and remain in contact with top 123 of stack of print media 122 as a height of stack of print media 122 changes. As also shown and discussed more fully below in connection with FIGS. 3 and 6, print media stack follower 120 is further configured to include encoded data 124 representative of various heights of stack of print media 122.

Print media level sensor 118 may be formed in a variety of different shapes and from various materials suitable for its function. In the embodiment shown in FIGS. 2, 3, and 6, print media stack follower 120 of print media level sensor 118 is formed in a generally L-shape, including differently sized arms 126 and 128 joined together at substantially a right angle. Suitable materials for print media level sensor 118 include plastic and metal.

Figure 3:
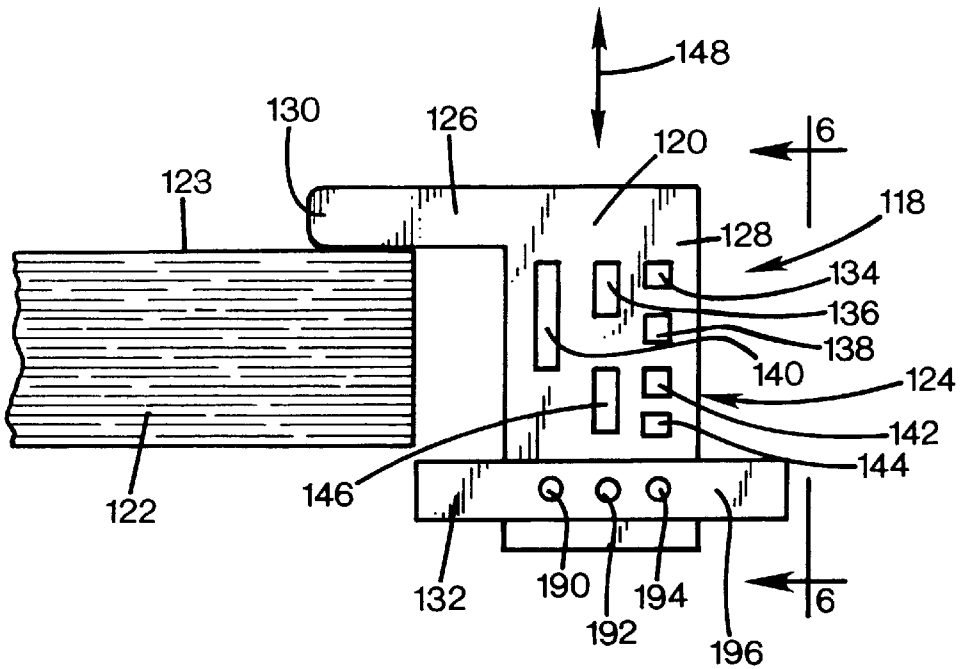
FIG. 3 is a side view of an embodiment of a print media level sensor in accordance with the present invention measuring a height of a stack of print media.

A side view of print media level sensor 118 measuring a height of stack of print media 122 is shown in FIG. 3. As can be seen in FIG. 3, arm 126 of print media stack follower 120 is in contact with top 123 of print media stack 122 and is formed to include a tapered end 130 to help prevent damage to sheets of print media located at top 123 caused by tearing. As can also be seen in FIG. 3, print media level sensor 118 additionally includes a decoder 132 that is configured to read encoded data 124 on arm 128 of print media stack follower 120. Decoder 132 is further configured to output a signal representative of the encoded data to computing device 40 which is coupled to decoder 132 to receive this signal representative of the encoded data. Computing device 40 is configured to convert the signal representative of the encoded data from decoder 132 into a signal representative of the height of stack of print media 122. This signal representative of the height can be sent to a user interface, such a display (not shown) of printing device 20 or monitor coupled to a computer host (also not shown).

Figure 4:
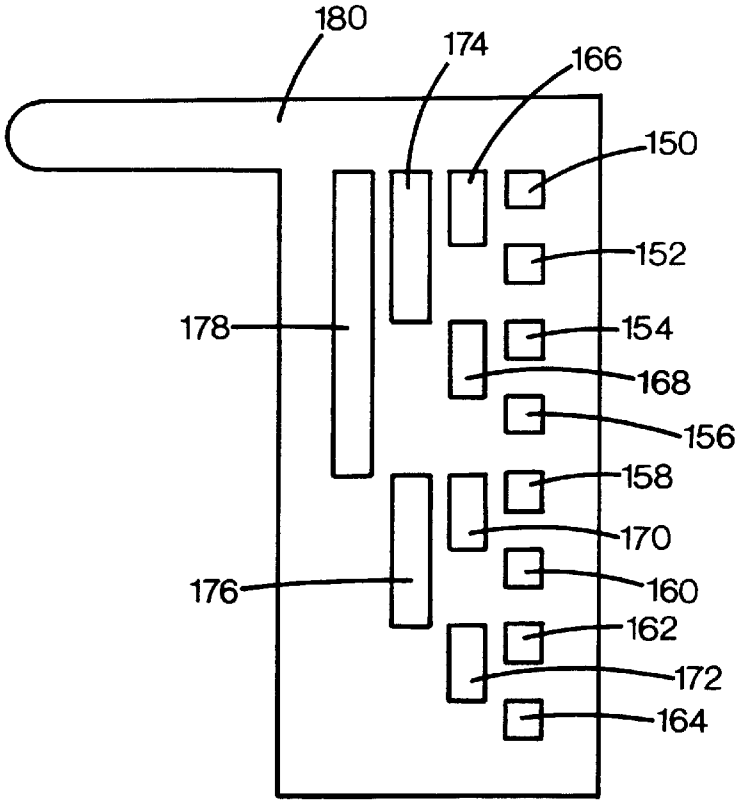
FIG. 4 is a side view of an alternative embodiment of a print media level sensor follower in accordance with the present invention.
Figure 5:
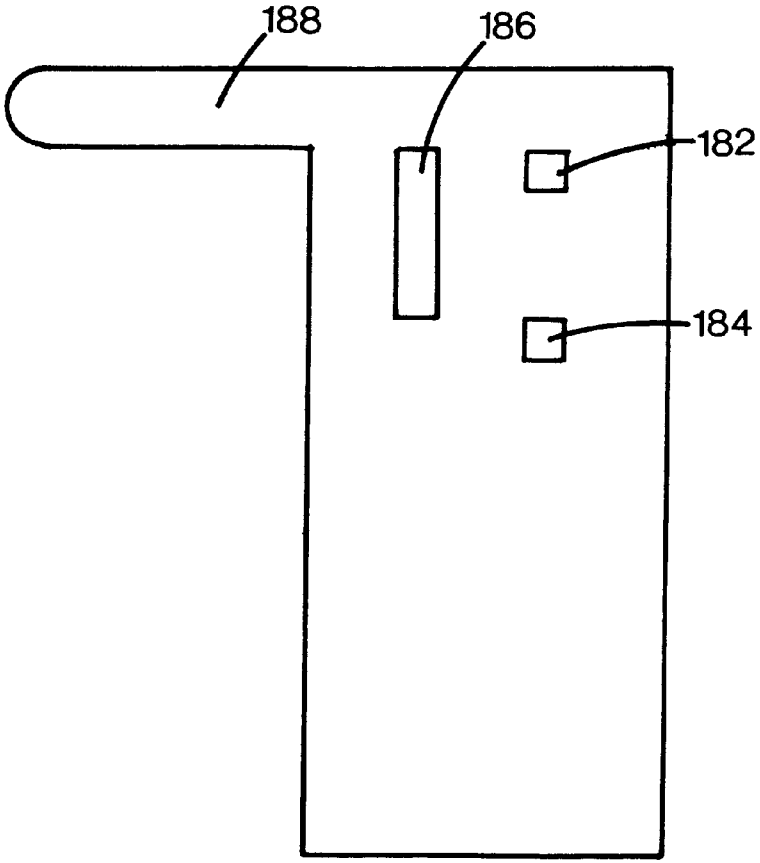
FIG. 5 is a side view of another alternative embodiment of a print media level sensor follower in accordance with the present invention.

As can additionally be seen in FIG. 3, encoded data 124 includes a plurality of apertures 134, 136, 138, 140, 142, 144, and 146 formed through arm 128 of print media stack follower 120. As can further be seen in FIG. 3, apertures 134, 136, 138, 140, 142, 144, and 146 are arranged in three columns and are configured to have three different sizes so as to encode eight (8) different stack of print media 122 height levels when print media stack follower 120 moves up or down in the direction shown by double-headed arrow 148 as the height of stack 122 respectively increases or decreases. Additional stack of print media 122 height levels can be detected by increasing the number of apertures and, if also necessary, sizing some or all of these additional apertures differently. For example, sixteen (16) different stack of print media 122 height levels can be detected through the use of fifteen (15) apertures 150, 152, 154, 156, 158, 160, 162, 164, 166, 168, 170, 172, 174, 176, and 178 of four different sizes arranged in four different columns like that shown in FIG. 4 for print media stack follower 180. As another example, four (4) different stack of print media 122 height levels can be detected through the use of three (3) apertures 182, 184 and 186 of two different sizes arranged in two different columns like that shown in FIG. 5 for print media stack follower 188.

Figure 6:
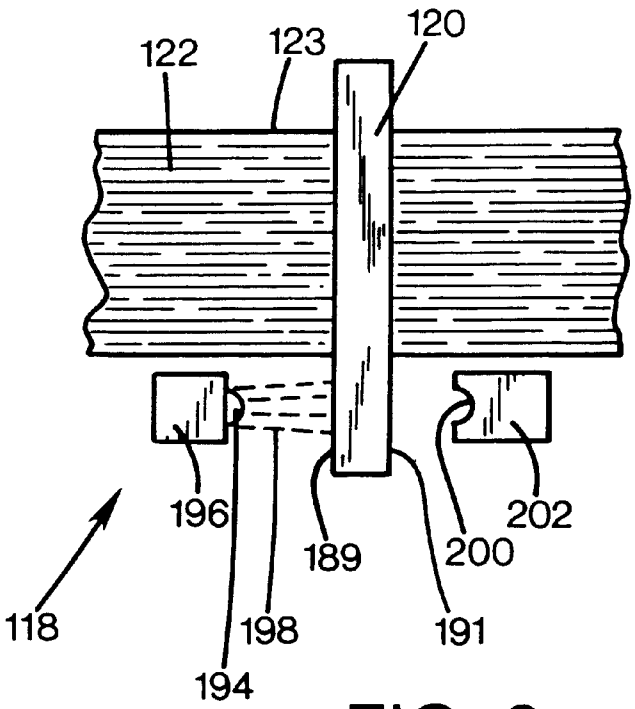
FIG. 6 is a view of the print media level sensor of FIG. 3 taken along line 6—6 of FIG. 3.

A side view of the print media level sensor 118 taken along line 6—6 of FIG. 3 is shown in FIG. 6. As can be seen in FIGS. 3 and 6, decoder 132 includes three sources 190, 192, and 194 that are secured in an emitter body 196 and positioned opposite side 189 of print media stack follower 120. Sources 190, 192, and 194 each transmit a light signal, such as light signal 198 of source 194, that, depending on the position of print media stack follower 120 which is dictated by the height of stack of print media 122, is either reflected from arm 128 of print media stack follower 120 or passed through one of apertures 134, 136, 138, 140, 142, 144, and 146 and received by one of three separate detectors, only one of which is shown in FIG. 6 (detector 200). These detectors are secured in a detector body 202 positioned opposite side 191 of print media stack follower 120. Each of these detectors is configured to convert any received light signal from one of respective sources 190, 192 or 194 into an electrical signal for use by computing device 40 in determining the height of stack of print media 122, as discussed above. This determination by computing device 40 may be made by means such as a look-up table or through calculation. For example, a look-up table might be implemented as follows:

| Decoder Signal | Media Level |
|---|---|
| 1 1 1 | Full |
| 1 1 0 | 7/8 |
| 1 0 1 | 3/4 |
| 1 0 0 | 5/8 |
| 0 1 1 | 1/2 |
| 0 1 0 | 3/8 |
| 0 0 1 | 1/4 |
| 0 0 0 | 1/8 or less |

Although the invention has been described and illustrated in detail, it is to be clearly understood that the same is intended by way of illustration and example only, and is not to be taken necessarily, unless otherwise stated, as an express limitation. For example, in one or more alternative embodiments of the present invention, encoded data on a print media stack follower is represented by reflective regions, rather than apertures in the print media stack follower. In such embodiments, the light sources and light detectors of a decoder are located on the same side of the print media stack follower. As another example, in alternative embodiments of the present invention, print media stack followers may be shaped differently, such as generally I-shaped. The spirit and scope of the present invention are to be limited only by the terms of the following claims.

What is claimed is:

1. A print media level sensor for use in a printing device, the print media level sensor comprising:

a print media stack follower, the print media stack follower configured to contact a top of a stack of print media and remain in contact with the top of the stack of print media as a height of the stack of print media changes, and the print media stack follower further configured to include encoded data representative of a plurality of heights of the stack of print media; and a decoder, the decoder configured to read the encoded data on the print media stack follower, and the decoder further configured to output a signal representative of the encoded data.

2. The print media level sensor of claim 1, further comprising a computing device coupled to the decoder to receive the signal representative of the encoded data therefrom, the computing device configured to convert the signal representative of the encoded data into a signal representative of the height of the stack of print media.

3. The print media level sensor of claim 1, wherein the encoded data is formed in a body of the print media stack follower.

4. The print media level sensor of claim 3, wherein the encoded data includes a plurality of apertures.

5. The print media level sensor of claim 1, wherein the decoder includes a source configured to emit a light signal and a detector configured to receive the light signal from the source and convert the light signal into an electrical signal.

6. A print media level sensor for use in a printing device, the print media level sensor comprising:

follower means for tracking a height of a stack of print media, the follower means configured to include encoded data means for representing a plurality of different stack of print media heights; and means for decoding the encoded data means, the means for decoding configured to output a signal representative of the encoded data.

7. The print media level sensor of claim 6, further comprising computing means coupled to the means for decoding to receive the signal representative of the encoded data therefrom, the computing means configured to translate the signal representative of the encoded data into a signal representative of the height of the stack of print media.

8. A method for determining a height of a stack of print media for use in a printing device, the method comprising:

tracking a height of a stack of print media via a print media stack follower, the print media stack follower configured to contact a top of a stack of print media and remain in contact with the top of the stack of print media as a height of the stack of print media changes;

encoding data representing a plurality of different stack of print media heights via the print media stack follower;

decoding the encoded data; and generating a signal representative of the encoded data.

9. The method of claim 8, further comprising converting the signal representative of the encoded data into a signal representative of the height of the stack of print media.

* * * * *